US005304390A

United States Patent [19]

Condron et al.

[11] Patent Number: 5,304,390

[45] Date of Patent: Apr. 19, 1994

[54] SUPERCRITICAL RATIO CONTROL SYSTEM UTILIZING A SONIC FLOW VENTURI AND AN AIR-DRIVEN POSITIVE DISPLACEMENT PUMP

[75] Inventors: James A. Condron, Hurricane; Edmond J. Derderian, Charleston, both of W. Va.; Alan E. Wang, Chicago, Ill.

[73] Assignee: Union Carbide Chemicals & Plastics Technology Corporation, Danbury, Conn.

[21] Appl. No.: 906,705

[22] Filed: Jun. 30, 1992

[51] Int. Cl.[5] ..... B05D 1/02; B05C 11/00

[52] U.S. Cl. ..... 427/8; 427/421; 427/426; 118/688; 118/663; 366/152; 366/160; 366/161; 137/3; 137/10

[58] Field of Search ..... 427/8, 421, 426; 118/688, 663; 239/407; 366/151, 152, 160, 161, 162; 137/3, 10

[56] References Cited

U.S. PATENT DOCUMENTS 4,228,815 10/1980 Juffa et al. ..... 137/10
4,582,731 4/1986 Smith ..... 427/421
4,621,927 11/1986 Hiroi ..... 366/132
4,734,227 3/1988 Smith ..... 264/13
4,734,451 3/1988 Smith ..... 524/493
4,882,107 11/1989 Cavender et al. ..... 264/51
4,923,720 5/1990 Lee et al. ..... 427/422
5,009,367 4/1991 Nielsen ..... 239/3
5,057,342 10/1991 Hoy et al. ..... 427/422

FOREIGN PATENT DOCUMENTS 1322237 7/1987 U.S.S.R. .

*Primary Examiner*—Shrive Beck
*Assistant Examiner*—David M. Maiorana
*Attorney, Agent, or Firm*—J. F. Leightner

[57] ABSTRACT

A process for delivering a predetermined ratio of a compressible fluid and a non-compressible fluid which comprises the measurement of only the flowrate of the compressible fluid, the activation of an air-driven positive displacement pump at appropriate times, the pumping of a non-compressible fluid with the air-driven pump, mixing the supercritical fluid and non-compressible fluid and depositing the mixture onto a substrate.

5 Claims, 3 Drawing Sheets

SUPERCRITICAL RATIO CONTROL SYSTEM UTILIZING A SONIC FLOW VENTURI AND AN AIR-DRIVEN POSITIVE DISPLACEMENT PUMP

FIELD OF THE INVENTION

This invention relates to the delivery of a defined ratio of compressible and non-compressible fluids. More particularly, this invention is directed to apparatus and processes for admixing a proportional amount of a non-compressible fluid and a supercritical fluid. The resultant mixture is suitable for spray application onto a substrate to be coated.

BACKGROUND OF THE INVENTION

The use of supercritical fluids as a transport medium for the manufacture of surface coatings is well known. For example, U.S. Pat. No. 4,923,720 discloses the use of supercritical fluids to reduce the consistency of viscous coating compositions to allow for their application as liquid sprays.

A particular type of coating commonly used in industrial applications is a mold release agent. Mold release agents find use in such varied arts as molding plastics, resins and elastomers, baking food products and coating surfaces, all of which utilize a release surface to prevent the adhesion of plastics, resins, food products and coatings, as the case may be, to the substrate to which they are supplied or applied.

One common method of applying a mold release agent to a substrate is to spray the agent onto the mold. The use of a supercritical fluid as a viscosity reduction medium in mold release spray applications has become more common with the environmental hazards associated with solvents and other volatile organic compounds.

U.S. Pat. No. 4,882,107 discloses a mold release coating process and apparatus using supercritical fluids. In either batch or continuous processes, predetermined amounts of supercritical fluid and mold release agent are both measured prior to mixing and being sprayed onto a substrate.

Measurement of the supercritical fluid flowrate may be accomplished by a variety of methods as the physical properties of the fluid are predictable. However measurement of the mold release agent is more complicated. Mold release agents are commonly waxes suspended in a solvent. The mixture has a viscosity which varies widely with shear rate, which increases the difficulty of flow measurement. The wax suspended in the solvent also tends to settle out or agglomerate and clog passageways in typical measurement metering devices, thus rending these devices unreliable.

Therefore it is of particular interest in the art to supply a controlled amount of a mold release agent to be mixed with a supercritical fluid which does not require the use of multiple flow meters to measure both the supercritical and non-compressible fluid.

SUMMARY OF THE INVENTION

The present invention provides a process for the delivery of a predetermined amount of a compressible fluid and a non-compressible fluid to be admixed which process requires measurement of only the compressible fluid. More particularly, the present invention is directed to a process of delivery of a predetermined ratio of a supercritical fluid carbon dioxide, and a mold release composition which requires flow measurement of only the supercritical fluid carbon dioxide. The process comprises the steps of:

a) providing a compressible fluid;

b) measuring the flow rate of the compressible fluid;

c) activating an air-driven positive displacement pump;

d) pumping a non-compressible fluid with the air-driven positive displacement pump;

e) mixing and controlling the pressure of the compressible fluid and non-compressible fluid;

f) depositing the compressible fluid/non-compressible fluid mixture onto a substrate. The admixed composition is suitable for spray coating applications. The invention also provides novel apparatus for carrying out the process.

DETAILED DESCRIPTION OF THE INVENTION

Figure 1:
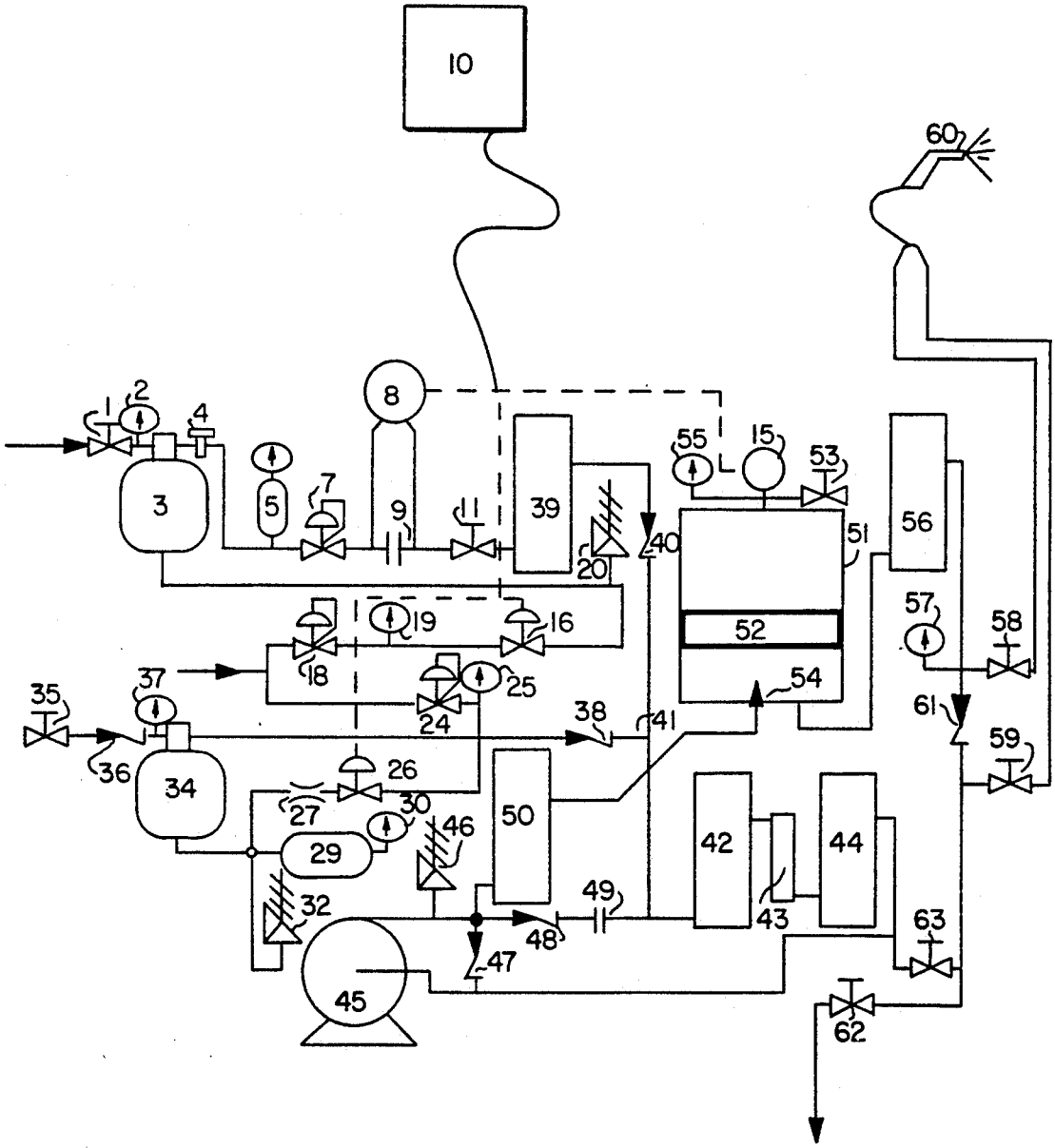
FIG. 1 is a schematic flow diagram of one embodiment of the present invention showing the basic elements of the unit used in preparing a mixture of compressible and non-compressible fluid and supplying it to a spray-gun.

The invention provides a spray mixing unit which is capable of delivering a specified amount of both a compressible fluid, such as a supercritical fluid (SCF) diluent, and a non-compressible fluid, preferably a mold release agent, by means which requires metering of only the compressible fluid. The non-compressible fluid is metered indirectly to the spray applicator by controlling the time-flow relationship of drive air to an air-driven positive displacement pump which is used to pump the non-compressible fluid.

Essentially any non-compressible fluid which is conventionally sprayed onto a substrate may be sprayed by means of the methods and apparatus discussed herein.

Such coating materials are typically used for painting and finishing operations or for applying various adhesive compositions, and the like. Such coating materials may also include those that are typically utilized in the agricultural field in which fertilizers, weed killing agents, and the like are dispensed.

Generally, such coating materials typically include a solids fraction containing at least one component which is capable of forming a coating on a substrate, whether such component is an adhesive, a paint, lacquer, varnish, chemical agent, lubricant, protective oil, non-aqueous detergent, or the like. Typically, at least one component is a polymer component which is well known to those skilled in the coatings art.

The constituents used in the solids fraction, such as the polymers, generally must be able to withstand the temperatures and/or pressures which are involved when they are ultimately admixed with the at least one supercritical fluid. Such applicable polymers include thermoplastic or thermosetting materials or may be crosslinkable film forming systems.

In particular, the polymeric components include vinyl, acrylic, styrenic, and interpolymers of the base vinyl, acrylic, and styrenic monomers; polyesters, oil-free alkyds, alkyds, and the like; polyurethanes, oil-modified polyurethanes and thermoplastic urethanes systems; epoxy systems; phenolic systems; cellulosic esters such as acetate butyrate, acetate propionate, and nitrocellulose; amino resins such as urea formaldehyde, melamine formaldehyde, and other aminoplast polymers and resins materials; natural gums and resins; rubber-based adhesives including nitrile rubbers which are copolymers of unsaturated nitriles with dienes, styrene-butadiene rubbers, thermoplastic rubbers, neoprene or polychloroprene rubbers, and the like.

In addition to the polymeric compound that may be contained in the solids fractions, conventional additives which are typically utilized in coatings may also be used. For example, pigments, pigment extenders, metallic flakes, fillers, drying agents, anti-foaming agents, and anti-skinning agents, wetting agents, ultraviolet absorbers, cross-linking agents, and mixtures thereof, may all be utilized in the coating material to be sprayed.

It is to be understood that solvency as it is used throughout, is intended to mean that the non-compressible fluid is rendered into a more dilute flowable condition by virtue of the compressible fluid. Solvency means dissolving, suspending or dispersing of the non-compressible fluid by the compressible fluid, usually a supercritical fluid, so that the combined mixture is characterizable by a lower viscosity and a more fluid composition for the transport of the non-compressible fluid.

The supercritical fluid phenomenon is well documented; see pages F-62–F-64 of the CRC Handbook of Chemistry and Physics, 67th Edition, 1986–1987, published by the CRC Press, Inc. Boca Raton, Fla. At high pressures above the critical point, the resulting supercritical fluid, or "dense gas", will attain densities approaching those of a liquid and will assume some of the properties of a liquid. These properties are dependent upon the composition, temperature, and pressure of the supercritical fluid.

The compressibility of supercritical fluids is great just above the critical temperature where small changes in pressure result in large changes in the behavior of supercritical fluid. The "liquid-like" behavior of a supercritical fluid at higher pressures results in greatly enhanced solubilizing capabilities compared to those of the "subcritical" compound, with higher diffusion coefficients and an extended useful temperature range compared to liquids. Compounds of high molecular weight can often be dissolved in the supercritical fluid at relatively low temperatures. An interesting phenomenon associated with supercritical fluids is the occurrence of a "threshold pressure" for solubility of a high molecular weight solute. As the pressure is increased, the solubility of the solute will often increase by many orders of magnitude with only a small pressure increase.

Near-supercritical liquids also demonstrate solubility characteristics and other pertinent properties similar to those of supercritical fluids. The solute may be a liquid at the supercritical temperatures, even though it is a solid at lower temperatures. In addition, it has been demonstrated that fluid "modifiers" can often alter supercritical fluid properties significantly, even in relatively low concentrations, greatly increasing solubility for some solutes. These variations are considered to be within the concept of supercritical fluid as used in the context of this invention. Therefore, as used herein, the phrase "supercritical fluid" denotes a compound above, at, or slightly below the critical temperature and pressure of that compound.

Examples of compounds which are known to have utility as supercritical fluids are given in Table 1. t,0220, CRC Handbook of Chemistry and Physics, supra.

Due to the low cost, low toxicity and low critical temperature of carbon dioxide, supercritical carbon dioxide fluid is preferably used in the practice of the present invention. For many of the same reasons, nitrous oxide ($N_2O$) is a desirable supercritical fluid in the practice of the present invention. However, use of any of the aforementioned supercritical fluids listed in Table 1 of CRC Handbook of Chemistry and Physics, supra, and mixtures thereof are to be considered within the scope of the present invention.

The solvency of supercritical carbon dioxide is similar to that of a lower aliphatic hydrocarbon and, as a result, one can consider supercritical carbon dioxide as a replacement for the hydrocarbon solvent of a conventional mold release formulation. In addition to the environmental benefit of replacing hydrocarbon solvents with supercritical carbon dioxide, there is a safety benefit also, because carbon dioxide is nonflammable and nontoxic.

The purpose of the invention is to utilize compressible fluids, especially supercritical fluids, in combination with non-compressible fluids for applying the non-compressible fluid to a substrate. Due to the difficulties in measuring the amount of mold release agent this invention is used with particular advantage to coat a substrate with a mold release agent.

Mold release agent as it is used throughout is intended to mean a composition which is utilized to enable an article to be removed from a mold when the mold is opened. Typically, mold release agents are liquids; however, solids can also be used.

Mold release agents come in many forms and compositions. Most mold release agents are waxes, wax-like or greases. For example, release agents for food products, which include hydrogenated vegetable oils such as shortenings, lecithin, and the like, are solid, wax-like or grease-like materials at operative food preparation temperatures.

There is commercially available a wide range of chemicals being offered as release agents. They vary from such compositions as: ethylene bis-stearamide; water soluble sulfated oil; dioctyl ester of sodium sulfosuccinic acid; nonpolar hydrocarbon solvents and petroleum oils; monoalkyl primary amines; straight chain aliphatic hydrocarbons; polyolefins; hydroxystearate; fatty acids in petroleum oil base; blends of fatty acid derivatives; dimethyl silicone fluids; silicone mica-glycol emulsions; single, double, and triple pressed and food grade stearic acids; single and double pressed oleic acids; distilled, phosphate mono- and diglycerides; modified fatty acid amides; emulsions of dimethylsiloxane; amide wax; oleyl palmitamide; stearyl erucamide; calcium stearate, zinc stearate, potassium and sodium ricinoleate; microcrystalline wax; N-(2-hydroxyethyl) 12-hydroxystearamide; polyvinylpyrrolidone; crystalline, aliphatic, saturate polyethylenes of 500 molecular weight; crystalline, aliphatic, saturated high density polyethylenes of 700, 1000 and 2000 molecular weight; emulsifiable high density polyethylene; fatty amido-amine salt; fatty amide; synthetic waxes; silicone oxyalkylene copolymers; methyl phenyl silicones; lecithin; and the like.

Many wax compounds suitable for use in this invention as mold release waxes are known to those skilled in the art. In general, wax refers to a substance which is a plastic solid at ambient temperature, but at moderately elevated temperatures becomes a low viscosity liquid. These include insect and animal waxes as well as petroleum waxes, polyethylene waxes, Fischer-Tropsch waxes, chemically modified hydrocarbon waxes and substituted amide waxes.

Silicone mold release agents are typically based on silicone liquid compositions such as polydimethylsiloxanes or polymethylphenylsiloxanes having a methyl or methyl and phenyl to silicon ratio of at least about 2, and preferably having a ratio of 2 or more. Silicon mold release agents can also be blended with hydrocarbon materials, such as solvents and waxes.

As pointed out above, the mold release agent may be employed in the practice of the invention without the use of a solvent other than the supercritical fluid solvent. The active solvent(s) other than the supercritical fluid suitable in the practice of this invention includes any solvent or mixture of solvents which is capable of dissolving, dispersing or suspending the mold release agent system in combination with the supercritical fluid. It is quite apparent that the selection of solvent will be dependent upon the mold release agent that is used. Since most release agents are oleophilic, the solvents will typically be hydrocarbon-based materials.

Generally, solvents suitable for this invention must have the desired solvency characteristics as aforementioned and also the proper balance of evaporation rates so as to insure good coating formation of the mold release agent. A review of the structural relationships important to the choice of solvent or solvent blend is given by Dileep et al, Industrial and Engineering Chemistry Product Research and Development, 24, 162, 1985 and Francis, A. W., Journal of Physical Chemistry, 58, 1099, 1954.

In order to diminish or minimize the unnecessary volatilization of any active solvent present in the fluid spray mixture, the amount of active solvent used should be less than that required to produce a mixture of mold release agent and active solvent having a viscosity which will permit its applications by fluid spray techniques. In other words, the inclusion of active solvent(s) should be diminished or minimized such that the diluent effect due to the presence of the supercritical fluid diluent is fully utilized.

Suitable active solvents include: aliphatic hydrocarbons such as hexane, heptane, octane, nonane, decane, undecane, dodecane, and other higher molecular weight aliphatic hydrocarbons; aromatic hydrocarbons such as benzene, toluene, xylene and other aromatics, either singly or in mixtures; halogenated aliphatic and aromatic hydrocarbons such as halogenated methanes, ethanes, propanes, and higher molecular weight homologs, as well as halogenated benzenes, and the like; oxygenated solvents such as alcohols, ketones, aldehydes, ethers, esters, glycol ethers, glycol ether esters and others; water; surface active compounds such as nonionic, anionic, cationic and amphoteric surfactants and the like. Mixtures of various active solvents may also be employed in the practice of the present invention.

In general, the amount of active solvent(s) should be minimized so that the beneficial effect due to the presence of the supercritical fluid is maximized. It is preferred that the only solvent used with the release agent is the supercritical fluid. However, the desired solvency, dispersibility or suspensionability of the mold release agent may not be achieved using a supercritical fluid alone. In that case, other active solvents are provided in the mold release agent formulation. Overall, the other solvent(s) is present in amounts ranging from 0 to about 70 weight percent based upon the total weight of the mold release agent(s), solvent(s), and supercritical fluid. In such a case, the solvent(s) is more typically present in the formulation of the mold release agent formulation in the range of from 0.15 weight percent to 60 weight percent based upon the weight of the total mold release agent(s), supercritical fluid and active solvent composition, and most preferably, between 0.3 weight percent and 50 weight percent on the same basis. Most preferably, the solvent(s) are present in amounts ranging from about 0.5 to 45 weight percent on the same basis. The choice of mold release agent(s) and active solvent(s) other than the supercritical fluid solvent should take into consideration the fact that the spray temperature cannot exceed the temperature at which thermal degradation of any component of the fluid spray mixture occurs. Therefore, these components should not degrade under the spray conditions.

The supercritical fluid diluent should be present in such amounts that a fluid mixture is formed that possesses such a viscosity that it may be applied as a fluid spray.

If supercritical carbon dioxide fluid is employed as the supercritical fluid diluent, i.e., another active solvent is present, preferably $CO_2$ should be present in the mixture with the mold release agent and the other active solvent(s) in amounts ranging from about 10 to about 95 weight percent based upon the total weight of components forming the sprayable release agent formulation. Most preferably, it is present in amounts ranging from about 20 to about 95 weight percent on the same basis.

If a mold release agent is mixed with increasing amounts of supercritical fluid in the absence of another active solvent, the composition may at some point separate into two distinct phases. Prior to this condition, the addition of the supercritical fluid, such as supercritical carbon dioxide, will have reduced the viscosity of the viscous mold release agent composition to a range where it can be readily atomized such as by passing it through a spray orifice of an airless spray gun. After atomization, a majority of the carbon dioxide vaporizes, leaving substantially the composition of the original mold release agent formulation. Upon contacting the substrate, the remaining fluid mixture of release agent and solvent(s) will flow to produce a thin, uniform, smooth film on the substrate. If the mold release agent is a wax, and another active solvent is not used, then the mold release agent may be solidified as fine particles that are uniformly deposited onto the release surface.

It is to be understood that a specific sequence of addition of the components of the mold release composition is not necessary in the practice of the present invention. However, it is often preferred to initially mix the release agent, such as a wax release agent, and the active solvent(s) other than the supercritical fluid, if they are employed. The present invention can be operated as a batch, semi-batch or continuous process.

The process and apparatus of the invention comprise a means for providing a compressible fluid, typically a supercritical fluid, a means for measuring the flow of the compressible fluid, means for calculating the amount of non-compressible fluid, i.e., a mold release agent to be mixed with the compressible fluid, means for activating an air-driven positive displacement pump to deliver the non-compressible fluid, means for reducing the viscosity of the non-compressible fluid, means for combining the non-compressible fluid and the compressible fluid and forming a mixture, means for controlling mixture pressure, maintaining the mixture in the supercritical state and a means for spraying the compressible fluid/non-compressible fluid mixture onto a substrate.

The accurate control of the operation of this air-driven positive displacement pump is necessary to deliver the predetermined level of mold release agent per unit of supercritical fluid. The air supply provided to the air-driven positive displacement mold release agent pump is maintained constant by means of a sonic venturi and capacity chamber installed in the air supply system.

A sonic venturi, or critical venturi as it is sometimes referred to, will characteristically deliver a very reproducible flow rate of air if upstream pressure and temperature are held constant and if downstream pressure is within certain limits. Within these limits, downstream conditions have no effect and are effectively removed from upstream conditions. Depending on the design and manufacturing techniques of the particular sonic venturi, variation in downstream pressure between zero and 75 to 95 percent of the upstream pressure will typically have no effect on the air flow rate determined by the sonic venturi.

In the present invention, an air reservoir is placed downstream of the sonic venturi to serve as a storage chamber. When a signal is sent to the non-compressible fluid pump to be started, the capacity chamber accepts air from the sonic venturi at a constant flow rate, but delivers air to the pump which is determined by the instantaneous drive air requirements of the pump. The reservoir will be delivering various flow rates of air which may be more or less than the flow rates than it is accepting. Reservoir pressure will correspondingly rise or fall with these instantaneous requirements.

The proper sizing of the air reservoir will properly maintain sonic velocity through the critical venturi. If the reservoir is undersized, pressure may temporarily rise in the reservoir to destroy sonic velocity through the venturi, whereas an oversized reservoir will result in sluggish non-compressible fluid pump control. In the latter situation, operation of the pump will significantly lag behind the activation or deactivation of the sonic venturi.

The sonic venturi pump system of the present invention is comprised of the following:

1) a compressible fluid feed which will activate automatically to maintain the desired system pressure;

2) means for measuring the flow rate of the compressible fluid;

3) means for counting compressible fluid flow signal pulses in a digital register;

4) means for outputting in response to digital register contents, an electrical signal to open the air control valve;

5) means to decrement flow signal pulses while the air control valve is open.

6) means to close the air control valve;

7) means to direct pressure controlled air from the solenoid air control valve to the sonic flow venturi which then activates the non-compressible fluid pump;

8) means to compute incrementing and decrementing compressible fluid flow signal values and to cycle the air solenoid valve to maintain the preset proportions between the non-compressible and the compressible fluid.

Items 3, 4, 5, 6, and 8 above explain the actions of a device commonly referred to as a controller. Such devices are commercially available and well known in the art of process control.

Referring to FIG. 1, which shows a schematic diagram of the present invention, a compressible fluid, typically supercritical carbon dioxide which is to be proportionately mixed with a non-compressible fluid to form a desired admixture is introduced through valve (1) from a supply source. From pressure gauge (2), the compressible fluid is pumped by a pumping means (3) through a filter (4) to a surge tank equipped with a pressure gauge (5), through a pressure control valve (7), and an orifice (9). The orifice is part of a metering device (8), which sends a signal to controller (10). The compressible fluid is then sent through a valve (11) heater (39) and check valve (40) to the merge point (41).

The non-compressible fluid, such as a mold release compound, is introduced through valve (35), check valve (36) and pressure gauge (37) to the mold release pump (34). The discharge of the pump is fed to the check valve (38) and to the merge point (41) where the compressible and non-compressible fluids are admixed.

The compressible and non-compressible fluids admixture is then fed through a heater (42), a static mixer (43), another heater (44), and to the suction side of recirculating pump (45). After undergoing a pressure increase from the pump's mechanical action, the admixture is directed past a relief device (46 and 47). A small portion is directed through check valve (48) and restriction orifice (49) and recirculated back to the entry point of the feed from the merge point. A majority of the non-compressible fluid from the discharge of the recirculation pump is directed through another heater (50) and into the liquid end of a gas-liquid accumulator (51).

The accumulator is a sealed vessel, generally cylindrical in shape, with a free diaphragm barrier (52) between the upper gas volume and the lower liquid volume. At normal operating pressures, the diaphragm will be positioned such that the gas and liquid pressures are nearly equal. The gas side of the accumulator is typically charged with 1100 psi nitrogen through valve (53). Gas compressibility provides increased spray capacitance, i.e., less pressure change per unit of liquid volume inventory change, which is necessary for proper pressure control of the apparatus. Providing a large liquid volume in the accumulator in conjunction with a high-velocity entrance jetting nozzle (54) can be advantageously used to allow higher velocity of the entering material to promote turbulent flow and mixing. A pressure sensor (15) and pressure gauge (55) is advantageously placed on the non-fouling gas side of the accumulator.

Accumulator outflow is directed through another heater (56), and then to pressure gauge (57), valve (58) and spray gun (60). A relief bypass (61) is provided to accommodate closed or non-circulating spray guns. Return from the spray gun is directed through valve (59), past drain valve (62) and through shutoff valve (63) back to the recirculation pump suction side.

Still referring to FIG. 1, nominal filtered air, typically provided at 100 psi, is supplied to a pressure control valve (18) and through a pressure gauge (19) to the compressible fluid pump air-drive through solenoid control valve (16). Valve opening is initiated by transmission of a low pressure signal to a control device (10)

which also simultaneously activates the signal to a solenoid valve (26) which controls the passage of air from pressure control valve (24) to the critical venturi (27). The air supply then passes to the mold release pump (34) by way of the air reservoir tank (29). Reservoir air is supplied to the non-compressible fluid pump drive mechanism, and causes non-compressible fluid flow if the solenoid (26) remains open for a sufficient period of time. System pressure is limited through the use of pressure relief device (32).

In the present invention, the selection of the non-compressible fluid pump is critical in order to attain a predictable relationship between the active air-drive and the delivered non-compressible fluid flowrate. The selected pump must deliver a known volume of non-compressible fluid per unit of drive-air at a specific set of conditions. The delivery of mold release fluid per unit air consumption may be obtained by test or calculation, but must be based on the level of fluid delivered in one full pump cycle. These pumps are commercially available from various suppliers such as Haskel Inc., Nordson, Graco and Binks. Especially preferred is Haskel model number DSF-35.

Figure 2:
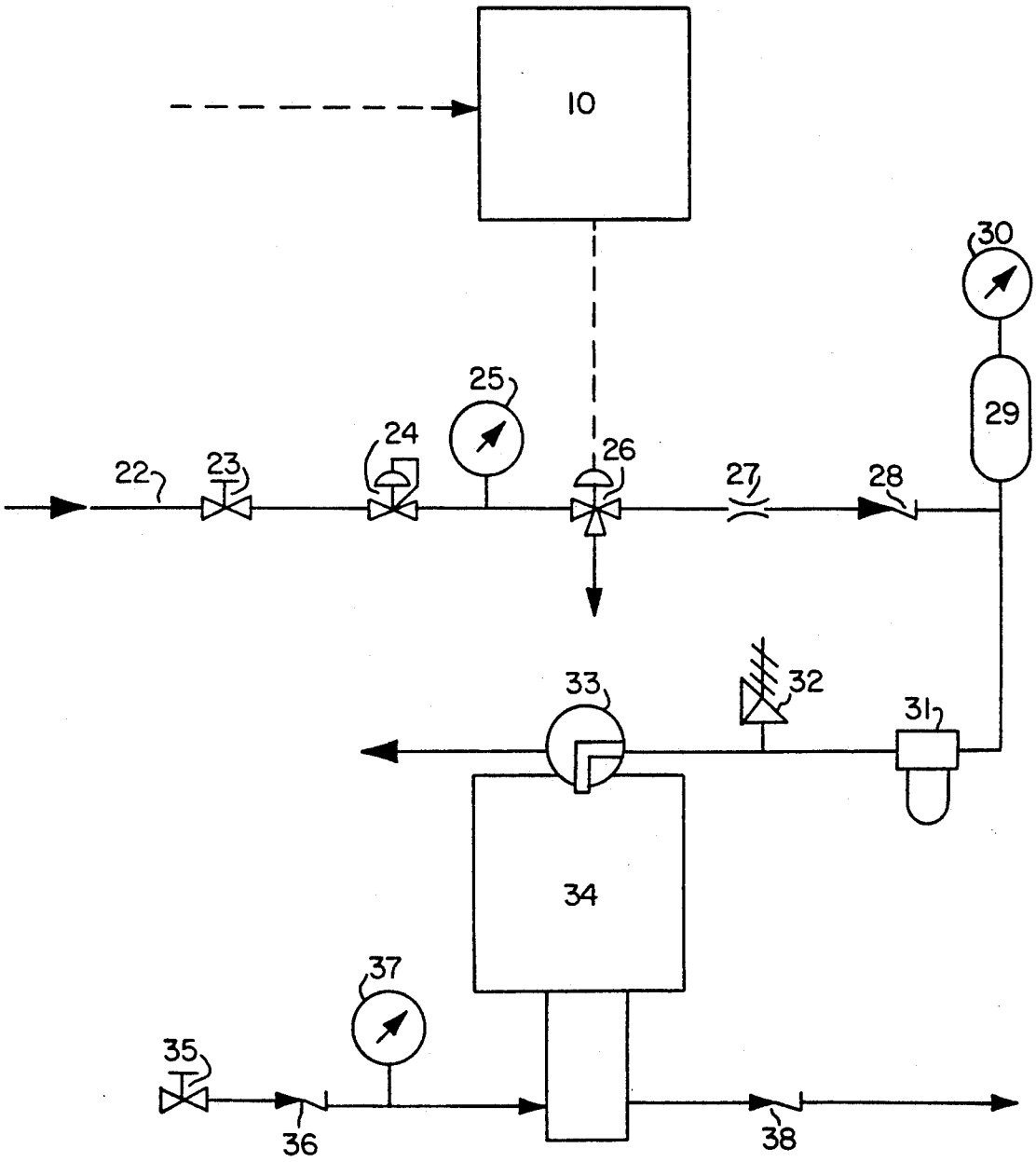
FIG. 2 is a more detailed schematic diagram of the non-compressible fluid feed system shown in FIG. 1.

A more detailed schematic drawing of the non-compressible fluid air-drive is provided in FIG. 2. The flow rate of the compressible fluid stream is monitored by the ratio controller (10). Filtered air typically delivered at 100 psi through line (22) is fed through a shut-off valve (23), a pressure control valve (24), pressure gauge (25), and solenoid valve (26). According to the output of the ratio controller the solenoid valve is either closed and vented to the atmosphere or open to the sonic venturi (27) with a 1/16 inch bore. The outlet of the venturi is directed to a ½ inch Haskel 1 psi check valve (28). The discharge of the check valve is fed to a 300 milliliter reservoir storage tank (29) with pressure gauge (30). The air is then filtered through a filter (31). The filtered air system is equipped with a 62 psi relief valve (32). The air is then fed to the integral pump cycling valve (33) mounted integrally within a Haskel DSF-35 mold release concentrate pump (34). When the solenoid is inactive, any air leakage through the solenoid valve is vented, but the check valve (28) prevents depressurization of the reservoir.

When the pump air-drive system is active, non-compressible fluid flows through valve (35), check valve (36), and pressure gauge (37) to pump (34). The pump increases pressure and delivers the non-compressible fluid through check valve (38) to the merge point not shown.

Figure 3:
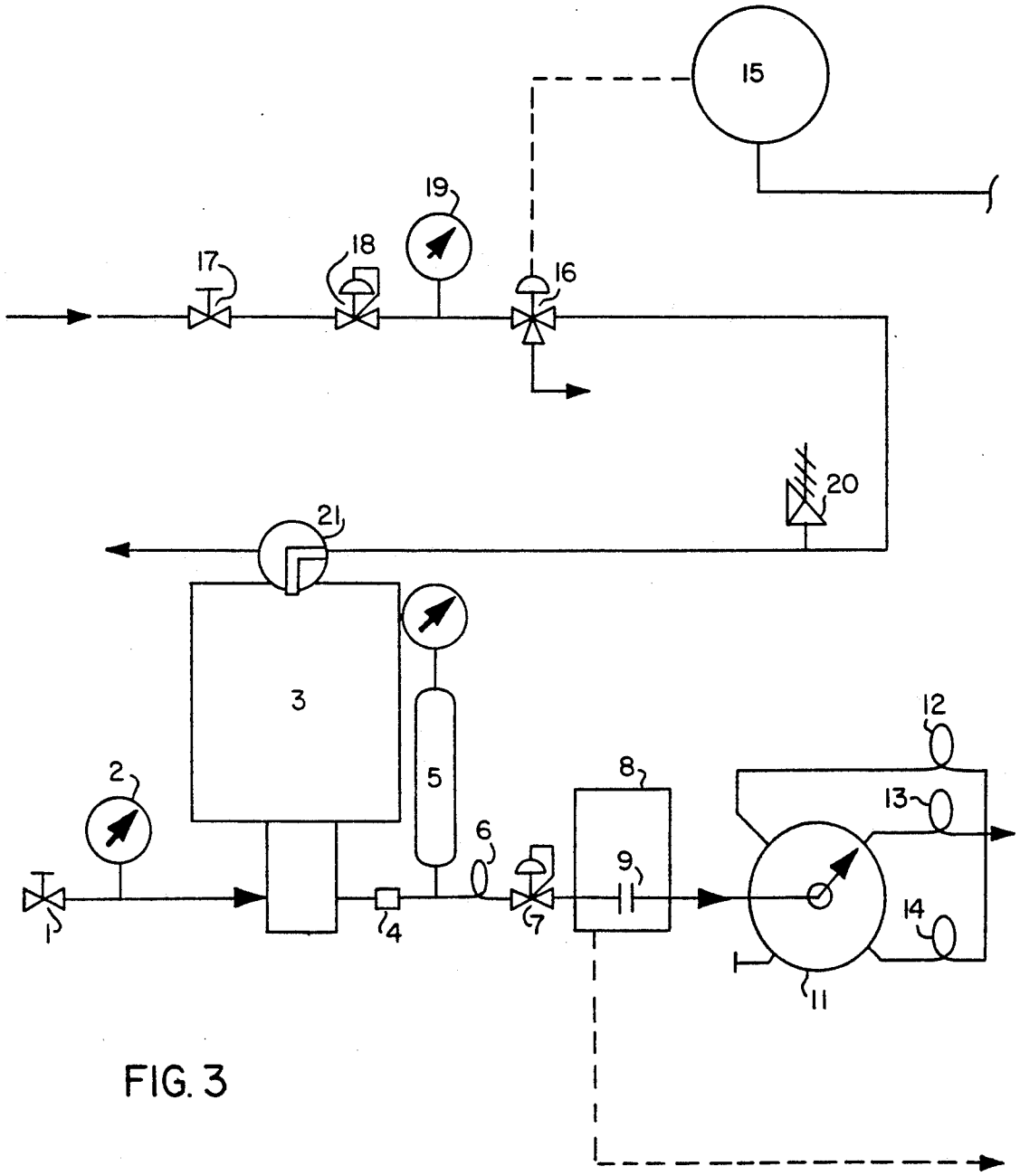
FIG. 3 is a more detailed schematic diagram of the compressible fluid feed system shown in FIG. 1.

A more detailed schematic drawing of the compressible fluid system is presented in FIG. 3. A pressure switch (15) monitoring the pressure in the accumulator gas chamber sends a signal (indirectly via the controller, not shown for simplicity) to the Numatics solenoid valve (16) in the 100 psi filtered air system. When the solenoid valve is open, air is supplied through shutoff valve (17), pressure regulator (18), and pressure gauge (19) to pressure relief valve (20) (86 psi) and on to the Haskel DSF-25 integral spool valve (21) which is used to drive the compressible fluid pump (3).

Compressible fluid is fed through valve (1) and gauge (2) to the compressible fluid pump (3), Haskel DSF-25, which discharges at approximately 2000 psi through filter (4) into a Whitey 316L 300 milliliter tank (5) equipped with a pressure gauge. The tank feeds into a twenty foot by ¼" OD tubing coil heat exchanger (6) and then into a Circle Seal pressure control valve (7). The compressible fluid flow rate is measured by differential pressure flow meter (8) (25 psid with 0.37" orifice (9) rated at 500 grams/minute) made by Rosemont Inc. The flow rate signal is then sent to the ratio controller (10), not shown. The metered compressible fluid is directed to the common inlet port of a multi-port selector valve (11). Individual outlet ports are either plugged or piped to a specific restrictor device. Typically a five-port valve will be used with one exit port plugged for a no-flow position and the remaining three ports directed to restrictors sized to deliver, in relative terms, low, medium or high carbon dioxide flowrates. Any type of restriction device may be used, but small-bore tubing is preferred on the basis of high reliability and cut-to-length sizing convenience. The function of these restrictors is to provide the spray unit operator with the capability to quickly select a nominal rate which can meet demands but does not permit compressible fluid flowrates which are too great or too small for accurate metering. Preferred metering range is between 20% and 100% of the metering device full scale flowrate. In a preferred embodiment of the present invention the low flow restrictor (12) is fifteen feet in length and 0.030" inside diameter, the medium flow restrictor (13) is 3 feet in length and 0.030 inches inside diameter; and the high flow restrictor (14) is 1 foot in length and 0.030 inches inside diameter.

Table 1 contains a list of parts used in the present invention.

TABLE 1

| ITEM | DESCRIPTION |
|---|---|
| 1 | Whitey, ball valve, SS-44S6 |
| 2 | McDaniel, pressure gauge, 0-200 psi |
| 3 | Haskel, air operated pump, DSF-25 |
| 4 | Nupro, filter, SS-6TF-60 |
| 5 | Whitey, sample cylinder, 316L-50DF4-300 |
| 6 | Handy & Harmon, tubing, SS ¼" OD × 0.035" wall |
| 7 | Circle Seal, Regulator, PR-55-B-1412 |
| 8 | Rosemount, dP transmitter, 3051CD3A52A1AM5 |
| 9 | Special, orifice, 0.037" bore |
| 10 | Fenner, controller, M-Trim |
| 11 | Whitey, ball valve, B-43ZF2 |
| 12 | Handy & Harmon, tubing, SS 1/16" OD × 0.030" ID × 15' |
| 13 | Handy & Harmon, tubing, SS 1/16" OD × 0.030" ID × 3' |
| 14 | Handy & Harmon, tubing, SS 1/16" OD × 0.030" ID × 1' |
| 15 | SOR, pressure switch, 9L-KA45-N7-F1A-VV |
| 16 | Numatics, solenoid valve, Mark 3 031SA4410 |
| 17 | Whitey, ball valve, SS-44S6 |
| 18 | Fairchild, 2-150 psi regulator, 10162 |
| 19 | McDaniel, pressure gauge, 0-100 psi |
| 20 | Circle Seal, relief valve, M-5133-B-2M-L-86 |
| 21 | Haskel, extreme cycling spool, 51050 |
| 22 | Parker, copper tubing, ⅜" OD |
| 23 | Whitey, ball valve, SS-44S6 |
| 24 | Fairchild, 2-150 psi regulator, 10162 |
| 25 | McDaniel, pressure gauge, 0-100 psi |
| 26 | Numatics, solenoid valve, Mark 3 031SA4410 |
| 27 | Special, venturi with 3/16" ports and 1/16" bore |
| 28 | Haskel, ½" check valve, 28303 |
| 29 | Whitey, sample cylinder, 304L-HDF4-300 |
| 30 | McDaniel, pressure gauge, 0-100 psi |
| 31 | Parker, ½" air filter, 07F31A |
| 32 | Circle Seal, relief valve, M-5133-B-2M-L-62 |
| 33 | Haskel, 3-way cycling spool, 29376 |
| 34 | Haskel, air operated pump, DSF-35 |
| 35 | Whitey, ball valve, SS-45F8 |
| 36 | Circle Seal, ½" check valve, 220-B-4PP-8 |
| 37 | McDaniel, pressure gauge, 0-3000 psi |
| 38 | Circle Seal, ½" check valve, 220-B-4PP-8 |
| 39 | Nordson, heater, NH-4 245676 |
| 40 | Circle Seal, ½" check valve, 220-B-4PP-8 |
| 41 | Nupro, tubing tee, SS-600-3 |

TABLE 1-continued

| ITEM | DESCRIPTION |
|---|---|
| 42 | Nordson, heater, NH-4 245676 |
| 43 | Kenics, static mixer, 37-06-110 |
| 44 | Nordson, heater, NH-4 245676 |
| 45 | Ross, hydraulic Torqmotor, MF-24-11-10-AAAA |
| 46 | Teledyne Republic, 2300 psi safety valve, 1632B-3-1/4-2 |
| 47 | Nupro, 100 psi check valve, SS-6C-100 |
| 48 | Haskel, ½" check valve, 28303 |
| 49 | Special, orifice, 1/16" bore |
| 50 | Nordson, heater, NH-4 245676 |
| 51 | Tobul, accumulator, 4.7A30-4 ½ Gal |
| 51 | Tobul, piston, for 4.7A30-4 with Buna-N seal |
| 53 | Tobul, gas valve, 2523 |
| 54 | Special, nozzle, ¼" × 0.047" opening |
| 55 | McDaniel, pressure gauge, 0-3000 psi |
| 56 | Nordson, heater, NH-4 245676 |
| 57 | McDaniel, pressure gauge, 0-3000 psi |
| 58 | Whitey, ball valve, SS-44S6 |
| 59 | Whitey, ball valve, SS-44S6 |
| 60 | Nordson, spray gun, SCF Model 1 |
| 61 | Nupro, 50 psi check valve, SS-6C-50 |
| 62 | Whitey, valve, SS-6NBS6 |
| 63 | Whitey, ball valve, SS-44S6 |

Whereas the exact scope of the present invention is set forth in the appended claims, the following specific examples illustrate certain aspects of the present invention and, more particularly, point out methods of evaluating the same. However, the examples are set forth for illustration only and are not to be construed as limitations on the present invention except as set forth in the appended claims. All parts and percentages are by weight unless otherwise specified.

EXAMPLE 1

The spray apparatus shown in FIG. 1 was used to deliver an amount of supercritical carbon dioxide and mold release composition in a predetermined ratio to a mold surface in the following manner.

A cast aluminum 15"×15"×5" laboratory mold was used for the purpose. In a typical HR (high resiliency) molded foam application, the mold temperature is about 65° C. Bone-dry carbon dioxide available from Cardox was introduced to the equipment at 750 psig pressure from a cylinder. The mold release was a high solids concentrate from Park Chemical Company consisting essentially of microcrystalline and/or polyethylene waxes and hydrocarbon solvents. The release material was sprayed at 1600 psig and 55° C. using an airless spray gun having a 0.04 gallon per minute orifice in the spray tip producing an 8-inch spray fan width. A total of 3.3 grams of the concentrate and 3.0 grams of carbon dioxide were sprayed on the mold.

Prior to the application of the release material, the mold surface was wiped clean of any residual wax from prior applications. A typical high density (3.3 parts water per hundred parts polyol) HR molded foam formulation was poured into the mold and the mold was sealed. At the end of the customary de-mold time for this formulation (3 minutes), the lid was opened and the polyurethane foam was found to release easily and cleanly from the mold. The foam had a good, smooth surface typical of this formulation.

EXAMPLE 2

The same apparatus, mold, carbon dioxide, high solids mold release concentrate of Example 1 were used. The release material was sprayed at 1600 psig and 55° C. using an airless spray gun having a 0.04 gallon per minute orifice in the spray tip with an 8-inch spray fan width. A total of 3.3 grams of the concentrate and 3.0 grams of carbon dioxide were sprayed on the mold.

Prior to the application of the release material, the mold surface was wiped clean of any residual wax from prior applications. A typical low density (4.2 parts water per hundred parts polyol) HR molded foam formulation was poured into the mold and the mold was sealed. At the end of the customary de-mold time for this formulation (3 minutes), the lid was opened and the polyurethane foam was found to release easily and cleanly from the mold. The foam had a good, smooth surface typical of this formulation.

EXAMPLE 3

The same apparatus and high solids mold release concentrate of Example 1 were used. The mold was a commercial mold typically used to make polyurethane foam parts for automotive seating, such as a bench seat back. Bone-dry grade carbon dioxide available from Cardox was introduced to the equipment at 300 psig pressure from a cryogenic cylinder. The release material was sprayed at 1600 psig and 55° C. using an airless spray gun having a 0.14 gallons per minute orifice in the spray tip with an 8-inch spray width. A total of 16.0 grams of the concentrate and 14.2 grams of carbon dioxide were sprayed on the mold.

Prior to the application of the release material, the mold surface was wiped clean of any residual wax from prior applications. A typical low density (4.2 parts water per hundred parts polyol) HR molded foam formulation was poured into the mold and the mold was sealed. At the end of the customary de-mold time for this formulation (3 minutes), the lid was opened and the polyurethane foam was found to release easily and cleanly from the mold. The foam had a good, smooth surface typical of this formulation.

Examples 1, 2, and 3 demonstrate the efficacy of the spray apparatus shown in FIG. 1 to spray an effective amount of mold release agent onto both a laboratory and commercial size mold. When the mold was opened, the foam was easily removed and the foam article had a desirable smooth surface.

EXAMPLE 4

The same apparatus, mold, carbon dioxide, high solids mold release concentrate and foam formulation of Example 1 were used. The release material was sprayed on the lid of the mold, but none was sprayed in the cavity. At the end of the customary de-mold time for this formulation (3 minutes), the lid was opened. The foam part could not be demolded; it was stuck to the cavity and could only be removed by tearing it in pieces, rendering it useless.

We claim:

1. A process for delivering a ratio of a compressible fluid and non-compressible fluid composition onto a substrate which comprises the steps of:

a) providing a compressible fluid;

b) measuring the flow rate of the compressible fluid;

c) activating an air-driven positive displacement pump, through the use of a sonic venturi, based upon the flow rate of the compressible fluid;

d) pumping a non-compressible fluid with the air-driven positive displacement pump;

e) mixing the compressible fluid and non-compressible fluid composition; and f) depositing the compressible fluid and non-compressible fluid onto a substrate.

2. The process of claim 1 in which the compressible fluid is supercritical carbon dioxide.

3. The process of claim 1 in which the non-compressible fluid is a mold release agent.

4. The process of claim 3 in which the mold release composition and the compressible fluid are mixed and are in the supercritical state.

5. The process of claim 3 in which the compressible fluid and mold release composition is heated prior to deposition onto a substrate.

* * * * *